US006014850A

United States Patent [19]

LeMire

[11] Patent Number: 6,014,850

[45] Date of Patent: Jan. 18, 2000

[54] CARRY HANDLE ATTACHMENT SYSTEM FOR PACKAGES

[75] Inventor: Paul LeMire, Jacksboro, Tenn.

[73] Assignee: Allen Field Company, Inc., Farmingdale, N.Y.

[21] Appl. No.: 09/059,238

[22] Filed: Apr. 13, 1998

Related U.S. Application Data

[60] Provisional application No. 60/043,679, Apr. 14, 1998.

[51] Int. Cl.[7] ..... B65B 61/14

[52] U.S. Cl. ..... 53/134.1; 220/754; 220/759; 220/770

[58] Field of Search ..... 53/134.1, 413; 220/754, 759, 768, 770; 294/117.19; 83/30, 660; 227/60, 67, 76

[56] References Cited

U.S. PATENT DOCUMENTS

| | | | |
|---|---|---|---|
| 2,128,723 | 8/1938 | Zettler | 229/52 A |
| 3,016,136 | 1/1962 | Poupitch | 16/125 X |
| 3,036,704 | 8/1962 | Meisenheimer | 206/143 |
| 3,412,651 | 12/1967 | Thibault | 229/117.24 |
| 3,626,879 | 12/1971 | Heisler | 140/93 B |
| 4,176,423 | 12/1979 | Wigemark | 16/125 |
| 4,290,254 | 9/1981 | Brunone | 53/413 |
| 4,637,544 | 1/1987 | Quercetti | 229/44 R |
| 4,745,727 | 5/1988 | Cinotti | 53/134 |
| 5,095,683 | 3/1992 | Roberts et al. | 53/413 |
| 5,199,243 | 4/1993 | Vlasaty et al. | 53/410 |
| 5,437,390 | 8/1995 | Romick | 220/768 |

*Primary Examiner*—Joseph J. Hail, III
*Assistant Examiner*—Ed Tola
*Attorney, Agent, or Firm*—Nolte, Nolte & Hunter

[57] ABSTRACT

A molded one-piece flexible plastic strip handle includes a first wall at one end of the strip that extends from the mid-portion of the strip, a second wall attached by one end to the first wall forming a U with the first wall having its apex below the plane of the mid-portion, and a tongue that extends from the apex toward the second end of the strip and makes an acute angle with the first wall. An opening in the first wall is configured to receive the tongue when it is bent toward the opening by inserting the second wall and first wall in a predetermined opening in a container wall.

11 Claims, 5 Drawing Sheets

CARRY HANDLE ATTACHMENT SYSTEM FOR PACKAGES

This application is a continuation of provisional application Ser. No. 60/043,679 filed Apr. 14, 1998.

BACKGROUND OF THE INVENTION

1. Field of the Invention

The invention pertains to carry handles, more specifically to a carry handle designed for rapid attachment by machine to a package.

2. Description of the Prior Art

The prior art is replete with patented designs for attaching a carry handle to a container wall.

U.S. Pat. No. 4,290,254 patented Sep. 22, 1981 by W. Brunone, describes a thin resilient metal or plastic handle having a pair of parallel legs extending normal from a straight back which extends laterally beyond each leg in tapered shoulders. The free end of each leg has an outward depending barb.

A twin screw which is angled toward a moving conveyor of packages and aligned with the direction of movement of the conveyor moves the handles in the direction of conveyor movement so that each handle is aligned with one of the moving packages over an opening in the package.

The handles hang by their shoulders from a spiral slot in each screw. As the handles are moved along the screw each handle is moved down to the aligned package by the downward tilt of the screw until the screw forces the handle gradually down into the opening. The arms are squeezed together by the barb until the barb it passes through the opening whereupon the arms spring back to parallel.

U.S. Pat. No. 5,199,243 patented Apr. 6, 1993 by Vlasaty et al. describes a container having a pair of rectilinear slots in an outer wall of the container. A flat, relatively thin handle is aligned with the long dimension of the slots. Each end of the handle is inserted in a slot and then the handle is turned sideways so that wings at the ends of the handle prevent withdrawal of the handle ends from the outer wall of the container.

SUMMARY OF THE INVENTION

It is one object of the invention to provide a package carry handle that is designed for auto insertion into holes in the package.

It is another object of the invention that the handle is inserted without bending or twisting of the ends of the handle.

It is another object that the handle is molded in one piece.

It is another object that a plurality of the handles can be arranged in a side-by-side magazine for automatic separation for one-by-one delivery to the insertion point.

It is another object that the handle is designed to pass through plastic film over the package and into the package wall.

Other objects and advantages will be apparent to one reading the ensuing description of the invention.

A molded one-piece flexible plastic strip handle includes a mid portion having a first plane. A first wall at the first end of the strip handle extends from the mid portion. A second wall attached by one end of the second wall to the first wall forms a U with the first wall in which the apex of the U is below the first plane. A tongue extends from the apex toward the second end of the plastic strip handle. An opening in the first wall is configured to receive the tongue when the tongue is bent to the opening. The tongue makes an acute angle with the first wall. The opening in the first wall is configured to receive a tongue from a duplicate of the handle when the duplicate is stacked on the top of the handle. First machine element means adapted for bending the strip in a curve in which the tongue extends into the curve, contacts the strip. Second machine element means connected to the first machine element means is configured for inserting another end of the second wall of the strip into one of first and second holes in a package cover and for inserting the second end of the strip into the second one of the holes in the cover. Third machine element means for piercing a wrapper on the cover of the container is connected to the first machine element means.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
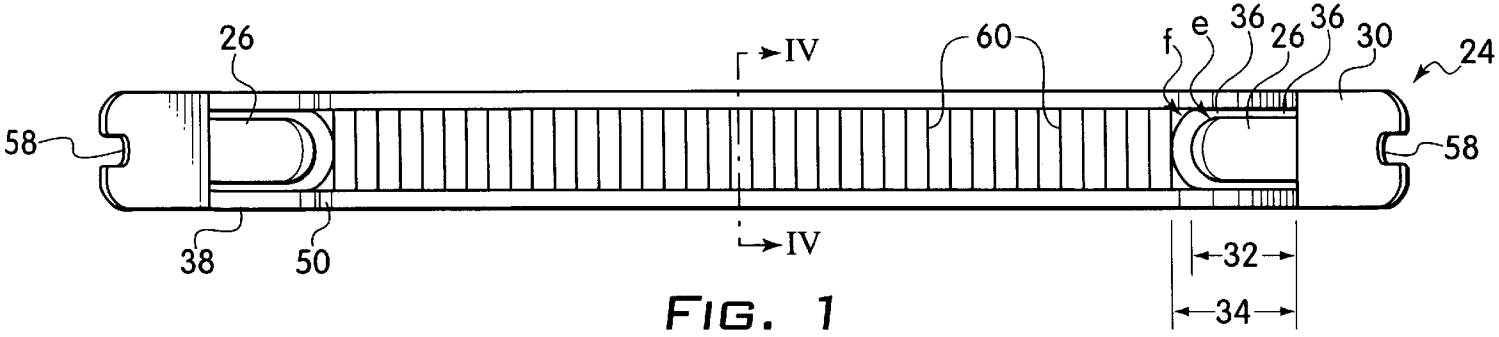
FIG. 1 is a top view of a handle of the invention.
Figure 2:
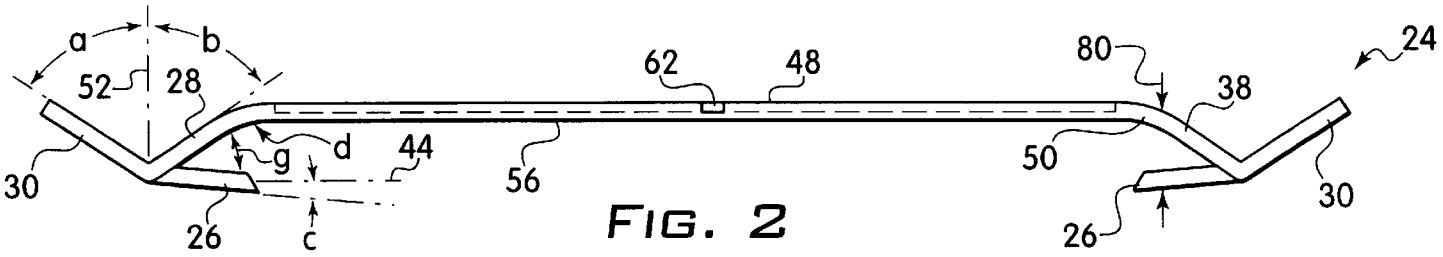
FIG. 2 is a front view of the handle of FIG. 1.
Figure 3:
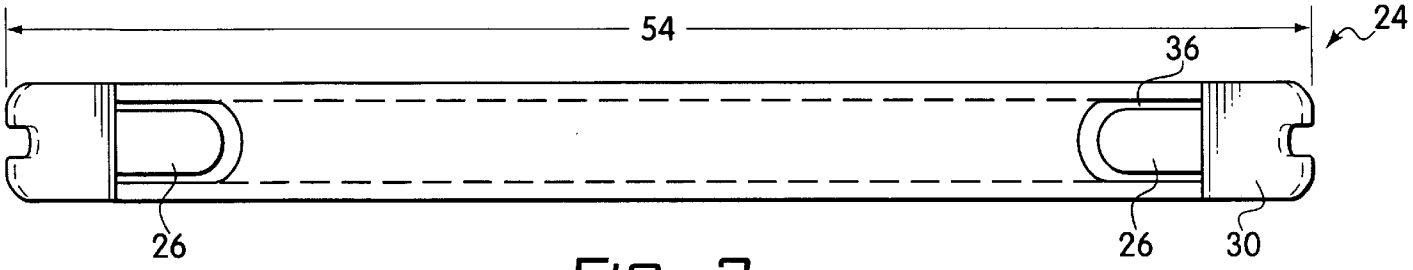
FIG. 3 is a bottom view of the handle of FIG. 1.
Figure 4:
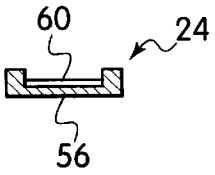
FIG. 4 is a cross section view of the mid portion of the handle of FIG. 1 taken along 4—4.
Figure 5:
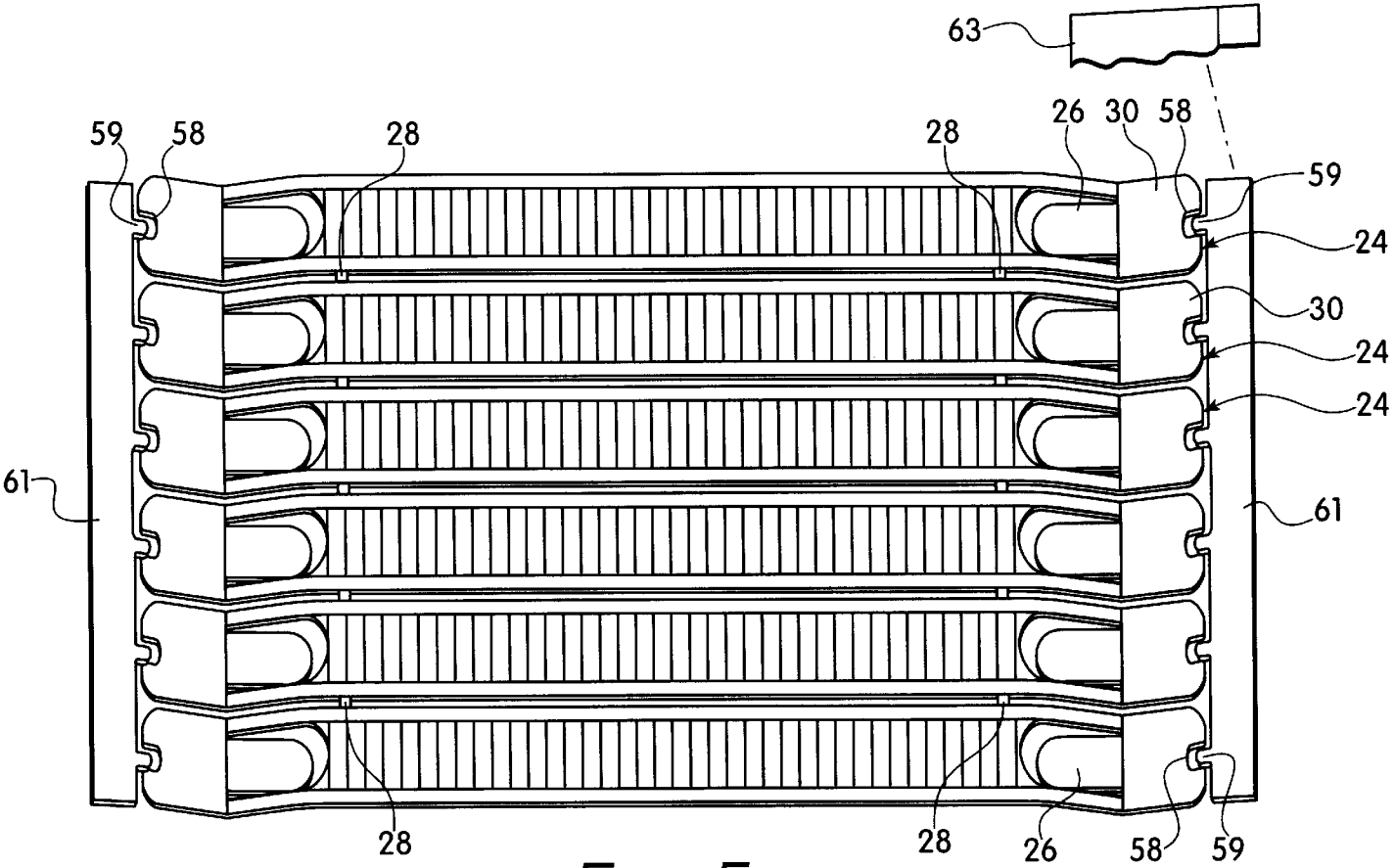
FIG. 5 is a perspective schematic view of a magazine of handles.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed, and various dimensions stated is for the purpose of description only and not of limitation.

Referring to the drawings,

In FIGS. 1–5, handle 24 is molded in one piece of flexible plastic including tongue 26 which extends from head 30. Handle 24 may be made in various sizes to accommodate package size. The handle is preferably molded as a 6-unit magazine in one piece, but may be molded with more or less than 6 units. The side-by-side handles of the magazine are attached by molded-in links 28. The 6-unit magazines are stacked in an automatic feed (not shown) from which the handles are cut and delivered one at a time for installation in a carton wall.

In handle 24 the length 32 of tongue 26 is less than the length of opening 34 so that there is a U-shaped space 36 around the head for unobstructed movement of the tongue by flexing, toward and into the plane of wall 38. If radius e is 0.15 inches, radius f is preferably 0.19 inches.

Tongue 26 is angled c preferably about 5 degrees from horizontal 44, and about 30 degrees g from wall 38. The about 4.5" long mid portion 48 of the overall length 54 of about 6 inches is parallel to horizontal 44.

Wall 38 and head 30 each make 30 degree angles a and b respectively with vertical 52. Shank 50 forms about a 75 degree radius d between wall 38 and the plane 56 of mid portion 48.

Shallow ribs 60 are provided on the top side of the handle. A high, solid rib 62 is also provided.

Notches 58 are designed to receive guide ridges 59 of stack bin 61 which is mounted on support frame 63.

FIGS. 6–9 show installation of handle 66 in openings 70 in carton wall 68.

Figure 6:
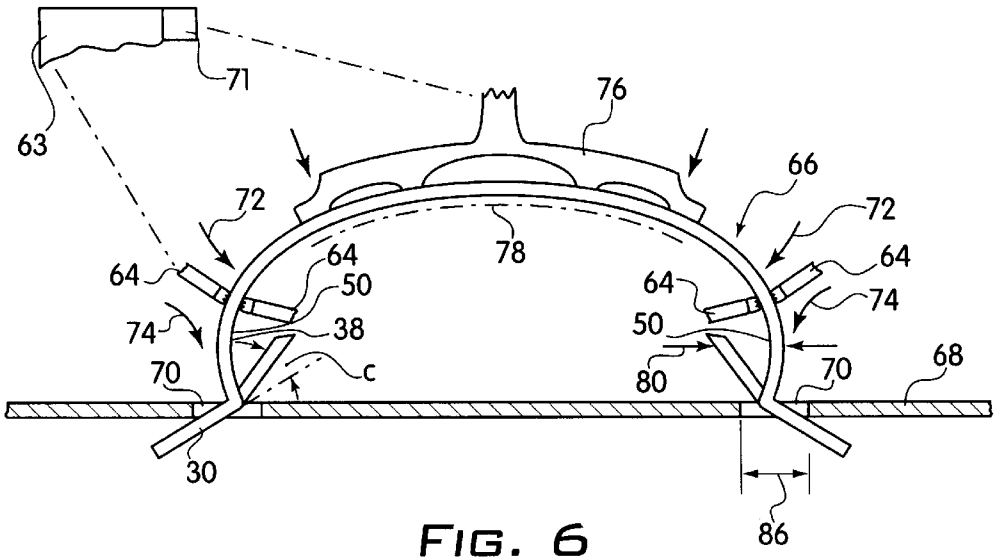
FIG. 6 is a schematic view of a handle being inserted in a carton wall.

In FIG. 6, the handle is bent into a U shape by grippers 64 which grip the handle behind shank 50 and force it inward 72 and downward 74. Curved arm 76 helps hold the U-shape curve 78 and urges the handle downward into openings 70. On each side of the handle, head 30 is already through the opening, and wall 38, shank 50, and tongue 26 are about to enter. Tongue 26 is still at about the 5 degree as-molded angle c.

Figure 7:
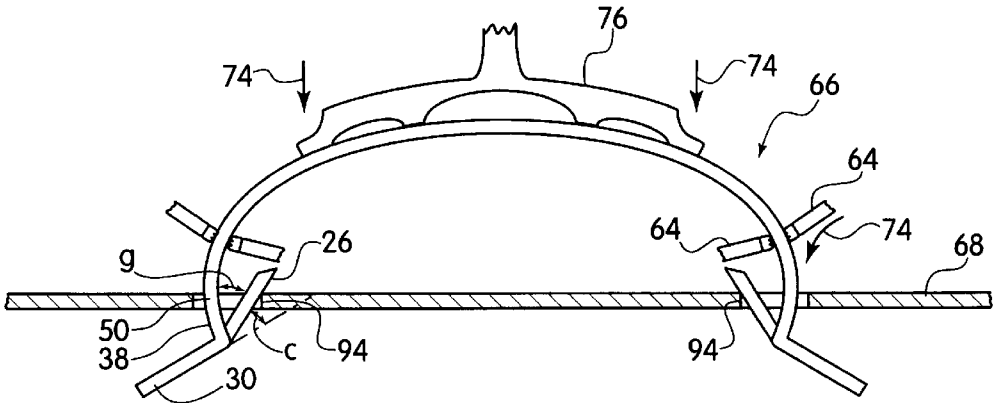
FIG. 7 is a schematic view of the handle of FIG. 6 being inserted in the carton wall.

In FIG. 7, wall 38 has passed through opening 70. Shank 50 and tongue 26 are simultaneously in opening 70. In the as-molded state, width 80 of shank-plus-tongue is greater than the width 86 of opening 70. When shank 50-plus-tongue 26 is in opening 70, tongue 26 is bent towards the shank by the surrounding wall 94 of the opening, angle c changes to 15 degrees and angle g changes to 20 degrees.

Figure 8:
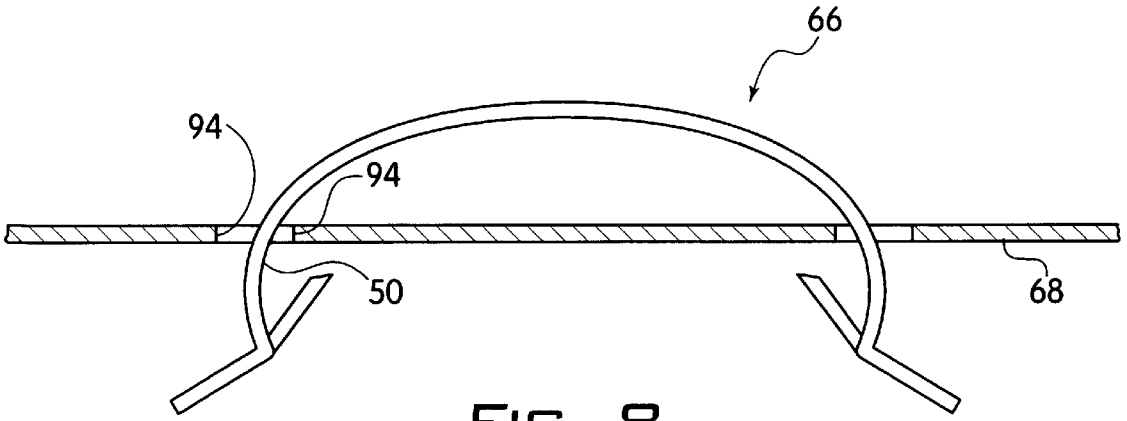
FIG. 8 is a schematic view of the handle of FIG. 6 inserted through the carton wall.

In FIG. 8, the shank has passed through the opening and tongue 26 springs back to the as-molded angle which is larger than the opening.

Figure 9:
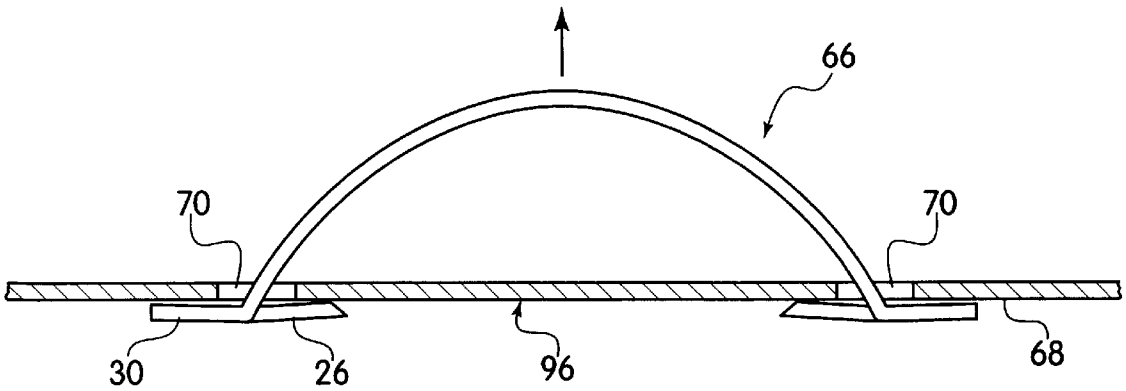
FIG. 9 is a schematic view of the handle of FIG. 6 inserted through the carton wall being pulled up from the carton wall.

In FIG. 9, handle 66 is pulled upward as if to carry the package. The shank is drawn back through the opening but the head and tongue cannot follow because since the shank-plus-tongue is wider than the opening, tongue 26 catches backside 96 of the carton wall and, in combination with head 30 prevents withdrawal of the handle from the hole. Pulling harder on the handle only forces the head and tongue further apart. The handle, in the above described size, was tested to carry weight up to 30 pounds.

Figure 10:
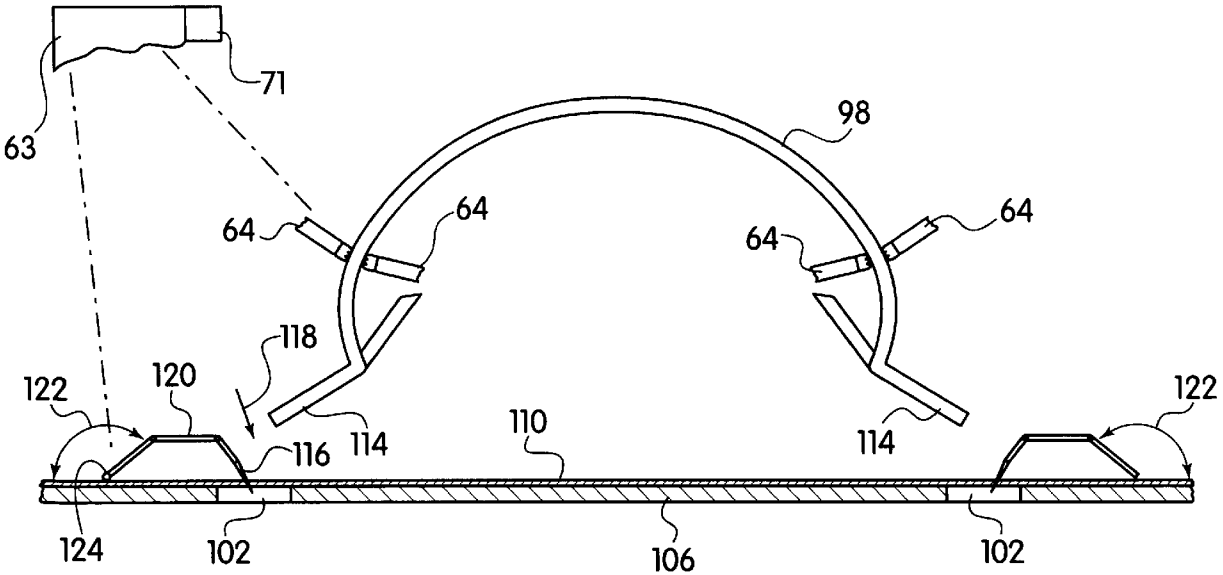
FIG. 10 is a schematic view of a package being prepared for a handle.

In FIG. 10, handle 98 is to be inserted in opening 102 in carton wall 106 which is covered with shrink wrap 110. Before head 114 is inserted in the opening, automatic knife 116 is inserted 118 through shrink wrap 110 by arm 120 which is reciprocated 122 by shaft 124. Automatic knife 116 may be a sharp implement, hot wire or other element suitable for cutting the wrap over the package. Knife 116, grippers 64, curved arm 76, and controller mechanism 71 are mounted on frame 63. Controller mechanism 71 controls the sequencing and timing of operations of the knife, grippers, and curved arm.

Figure 11:
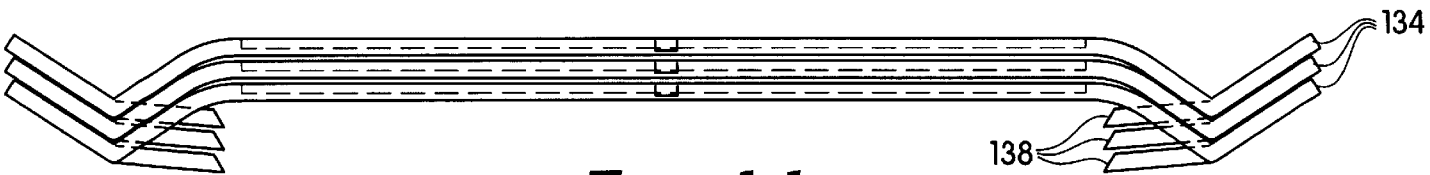
FIG. 11 is a schematic view of a plurality of stacked handles.

In FIG. 11, handles 134 are stacked. They may be stacked singly, in sets of six, sets of 20 or other quantity, or in a continuous belt. The tongue 138 of each upper handle nests in the opening in the handle below for the tongue of that handle below.

While the preferred embodiment of the invention has been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims.

What I claim is:

1. A package handle attachment system comprising:

a first molded one-piece flexible plastic strip handle comprising a first end, a second end, a top, a bottom, a front, a back, and a mid portion having a first plane, and a longitudinal axis;

a first wall at said first end extending from said mid-portion;

a second wall attached to said first wall forming a U with said first wall in which a apex of the U is below the first plane, and in which the U is drawn on a vertical plane congruent with the longitudinal axis of the mid-portion; and a tongue extending from said apex toward said second end.

2. The system of claim 1, further comprising:

an opening in said first wall configured to receive said tongue when said tongue is bent to said opening.

3. The system of claim 1, wherein said tongue makes an acute angle with said first wall.

4. The system of claim 2, wherein said tongue makes an acute angle with said first wall.

5. The system of claim 2 wherein said opening in said first wall is configured to receive a tongue from a duplicate handle of the first handle when the duplicate handle is stacked on the top of the first handle.

6. The system of claim 1 wherein said first wall forms an acute angle with a normal to the first plane.

7. The system of claim 6 wherein said second wall forms an acute angle with a normal to the first plane.

8. A system for attaching a carry handle to a package cover in a first hole and in a second hole spaced a predetermined distance from the first hole on the cover comprising:

a first molded one-piece flexible plastic strip handle comprising a first end, a second end, a top, a bottom, a front, a back, and a mid-portion having a first plane, a first wall at said first end extending from said mid-portion, a second wall attached by one end to said first wall forming a U with said first wall in which the apex of the U is below the first plane, a tongue extending from said apex toward said second end in an acute angle with said first wall, first machine element means contacting said strip adapted for bending said strip in a curve in which said tongue extends into said curve.

9. The system of claim 8 further comprising:

second machine element means connected to said first machine element means and configured for inserting another end of said second wall of the strip into one of the first and second holes in said cover and for inserting the second end of the bent strip into the second one of the holes in said cover.

10. A system for attaching a carry handle to a package cover in a first hole and in a second hole spaced a predetermined distance from the first hole on the cover comprising:

a first molded one-piece flexible plastic strip handle comprising;

a first end, a second end, a top, a bottom, a front, a back, and a mid-portion having a first plane, a first wall at said first end extending from said mid-portion, a second wall attached by one end to said first wall forming a U with said first wall in which the apex of the U is below the first plane, a tongue extending from said apex toward said second end in an acute angle with said first wall, first machine element means contacting said strip adapted for bending said strip in a curve in which said tongue extends into said curve;

second machine element means connected to said first machine element means and configured for inserting another end of said second wall of the strip into one of the first and second holes in said cover and for inserting the second end of the bent strip into the second one of the holes in said cover; and third machine element means for piercing a wrapper on the cover of the container, connected to said first machine element means and configured for piercing said wrapper when said wrapper is over said first hole for insertion of said second wall through the pierced wrapper.

11. The system of claim 10, further comprising:

an opening in said first wall configured to receive said tongue when said tongue is bent to said opening in said first wall by the inserting of said second wall and said first wall into one of said first and second holes in said cover.

* * * * *

UNITED STATES PATENT AND TRADEMARK OFFICE

CERTIFICATE OF CORRECTION

PATENT NO. : 6,014,850
DATED : January 18, 2000
INVENTOR(S) : LEMIRE

It is certified that error appears in the above-indentified patent and that said Letters Patent is hereby corrected as shown below:

On the title page, item [60]:

Provisional Application filing date should read --Apr. 14, 1997.--;

and on the specification page, column 1, line 5, the Provisional Application filing date should read --Apr. 14, 1997.--

Signed and Sealed this
Second Day of January, 2001

*Attest:*

*Attesting Officer*

Q. TODD DICKINSON

*Commissioner of Patents and Trademarks*